United States Patent [19]

Bennett

[11] Patent Number: 4,995,205

[45] Date of Patent: Feb. 26, 1991

[54] PRECAST STAIR SYSTEM

[76] Inventor: Eldon R. Bennett, 13011 Cross Creek Blvd., Apt. 82, Fort Myers, Fla. 33912

[21] Appl. No.: 322,496

[22] Filed: Mar. 13, 1989

[51] Int. Cl.[5] ..... E04F 19/10

[52] U.S. Cl. ..... 52/189; 52/190

[58] Field of Search ..... 52/189, 190, 188, 191

[56] References Cited

U.S. PATENT DOCUMENTS

| | | | |
|---|---|---|---|
| 1,985,143 | 12/1934 | Buffaloe | 52/189 |
| 2,171,951 | 9/1939 | Rosenberger | 52/189 |
| 2,218,523 | 10/1940 | Byington | 52/189 |
| 2,558,615 | 6/1951 | Johnson | 52/190 X |
| 3,466,820 | 9/1969 | Sender | 52/190 X |
| 3,805,464 | 4/1974 | Hanson | 52/190 |
| 3,834,098 | 9/1974 | Wutzke | 52/189 |
| 3,875,708 | 4/1975 | Thorsnes | 52/189 |

*Primary Examiner*—Richard E. Chilcot, Jr.
*Assistant Examiner*—Creighton Smith
*Attorney, Agent, or Firm*—William E. Noonan

[57] ABSTRACT

A precast stair system is disclosed, including a plurality of individually precast steps. Each step includes a tread portion and a riser portion that is integrally connected to the tread portion and extends generally downwardly therefrom. One or more elongate stringer elements are precast independently of the steps for supporting the steps and the steps are releasably fastened to each stringer element.

24 Claims, 3 Drawing Sheets

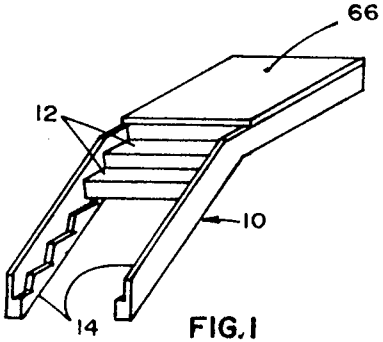
FIG. 1
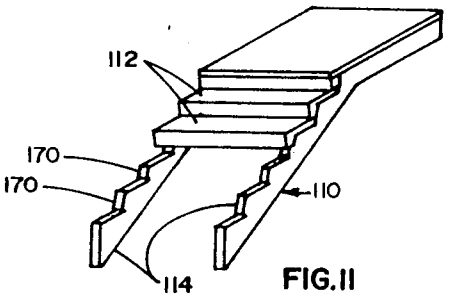
FIG. 11
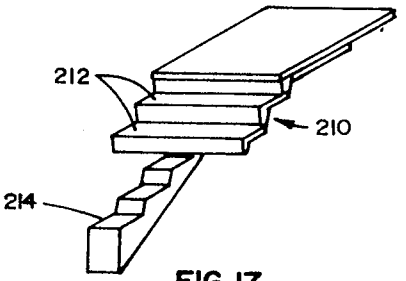
FIG. 17
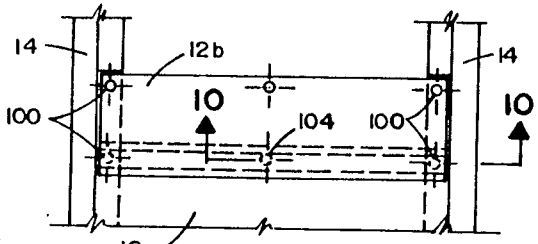
FIG. 9
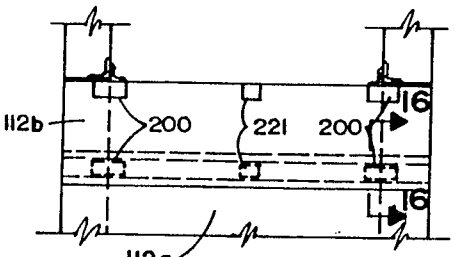
FIG. 15
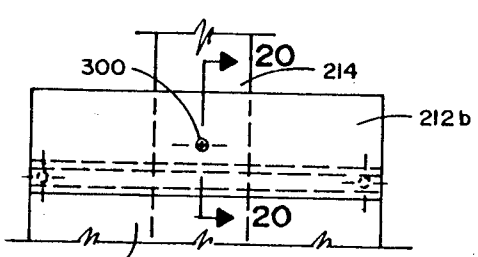
FIG. 19
FIG. 10
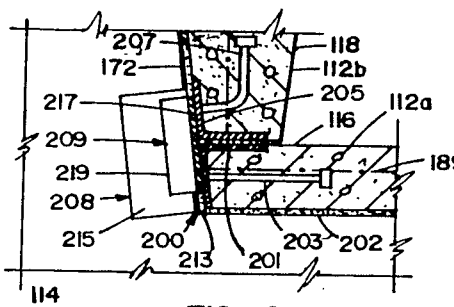
FIG. 16
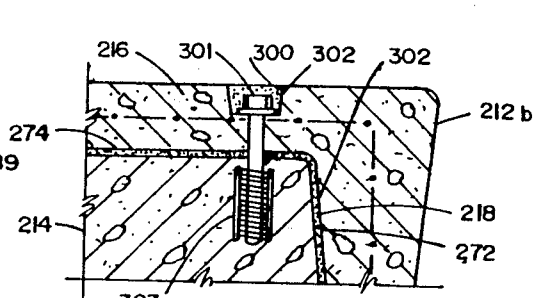
FIG. 20

PRECAST STAIR SYSTEM

FIELD OF THE INVENTION

This invention relates to a stair system and, more particularly, to a stairway constructed of precast concrete.

BACKGROUND OF THE INVENTION

Conventional precast concrete stairways exhibit a number of disadvantages. Very often, such stairs are constructed in a form or mold that has a step-shaped bottom surface for defining the steps and an open upper end into which the concrete is poured. This form creates a stairway that exhibits a heavy flat slab along its bottom surface. Such a stairway requires unnecessarily large amounts of concrete and is quite heavy. Moreover, because the bottom of the mold forms the steps, it is impossible to add a hardening or wear resistant material to the steps as they are forming in their wet condition. Such stair systems are also quite inflexible. The dimensions of each step form typically cannot be adjusted to match desired floor and building heights. A completely new form is required for each variation in height.

A stair system utilizing individually precast steps is known. In that system, steps are formed and then permanently cast into a pair of supporting side walls. Accordingly, worn or defective steps cannot be conveniently removed and replaced. Moreover, these steps are formed in an enclosed mold which, again, does not permit the addition of hardening or wear resistent materials to the concrete being cast. Additionally, this system does not permit the adjustment of tread depth and lateral width as well as riser height and width. And, as with many other precast stair systems, this stairway exhibits an inadequate fire rating due to its relatively thin steps. Many fire codes currently require a fire rating of at least two hours.

SUMMARY OF THE INVENTION

Therefore, it is an object of this invention to provide a precast stair system that employs individually precast steps that are readily removable from, and replaceable upon an independently precast stringer structure.

It is a further object of this invention to provide a precast stair system that employs less concrete material than is required in conventional systems.

It is a further object of this invention to provide a precast stair system that allows step dimensions to be conveniently adjusted.

It is a further object of this invention to provide a precast stair system that permits forms or molds to be reused for various building and floor heights.

It is a further object of this invention to provide a precast stair system that permits special hardening and wear resistent materials to be conveniently added during the formation process to improve stair wear and increase stair life.

It is a further object of this invention to provide a precast stair system that exhibits an improved fire rating.

This invention features a precast stair system that includes a plurality of individually precast steps. Each step includes a tread portion and a riser portion that is integrally connected to the tread portion and extends generally downwardly therefrom. There are elongate stringer means that are precast independently of the steps for supporting the steps and means are provided for releasably fastening the steps to the stringer means.

In a preferred embodiment, the system further includes means for releasably interconnecting each adjoining pair of steps. The tread portion may have an upper surface that includes a precast concrete and an integral hardening substance that increases the hardness and reduces wear of the upper surface. The tread portion and the riser portion may have a thickness such that the steps exhibit a two hour fire rating. The riser portion may include a generally downward draft of at least $\frac{1}{4}''$ per foot and preferably of approximately $1\frac{1}{2}''$ per foot.

The stringer means may include at least one element having a generally step-shaped recessed portion for conformably receiving the tread and riser portions of the steps. The recessed portion may extend across the entire width of the stringer element or only partially across the width of the stringer element. The stringer means may include a pair of generally parallel stringer elements for supporting respective ends of the steps. Alternatively, the stringer means may include a single stringer element that extends generally centrally beneath the steps.

This invention also features a mold for forming individual steps in the precast stair system. The mold includes an open upper end for receiving casting material, a first cavity portion having a generally flat, horizontally extendable floor for forming the tread portion of the step, and a second cavity portion that is connected to and depends from the first cavity portion. There are means such as filler elements and movable walls for adjusting the sizes of the first and second cavity portions to adjust the sizes of the tread and riser respectively. Further featured is a stringer mold including a pair of generally parallel extension cavity portions for forming upper and lower extension portions at the respective ends of the stringer. There is an inclined cavity portion that extends generally between the upper and lower extension cavity portions and includes a plurality of generally step-shaped core elements that form a generally step-shaped recessed portion of the stringer for supporting the steps of the stair system. A pair of transition cavity portions having predetermined angles interconnect respective ends of the inclined cavity portion with the extension cavity portions.

This invention also features a method of constructing a precast stair system including introducing casting material into a mold having an open upper end, a generally horizontally extendable first cavity portion and a generally vertically extendable second cavity portion that is dependably connected to the first cavity portion. The casting material is allowed to harden in the mold to form a precast step wherein the material in the first cavity portion forms the tread of the step and the material in the second cavity forms the riser of the step. The precast step is then removed from the mold and stringer means for supporting a plurality of precast steps are independently cast. The steps are releasably fastened to the stringer means. A filler element may be introduced into the mold to adjust the size of the step.

BRIEF DESCRIPTION OF THE DRAWINGS

Other objects, features and advantages will occur from the following description of preferred embodiments and the accompanying drawings in which:

FIG. 1 is a perspective view of a preferred precast stair system according to this invention;

FIG. 9 is a plan view of a portion of the step system of FIG. 1;

FIG. 10 is a cross sectional view taken along line 10—10 of FIG. 9;

FIG. 11 is an alternative preferred precast stair system according to this invention;

FIG. 15 is a plan view of a portion of the stair system of FIG. 11;

FIG. 16 is a cross sectional view taken along line 16—16 of FIG. 15;

FIG. 17 is a perspective view of further alternative preferred stair system according to this invention;

FIG. 19 is a plan view of a portion of the stair system of FIG. 17; and

FIG. 20 is a cross sectional view taken along line 20—20 of FIG. 19.

Figures 2, 6, 6A, 9A, 10A, 12, 18:
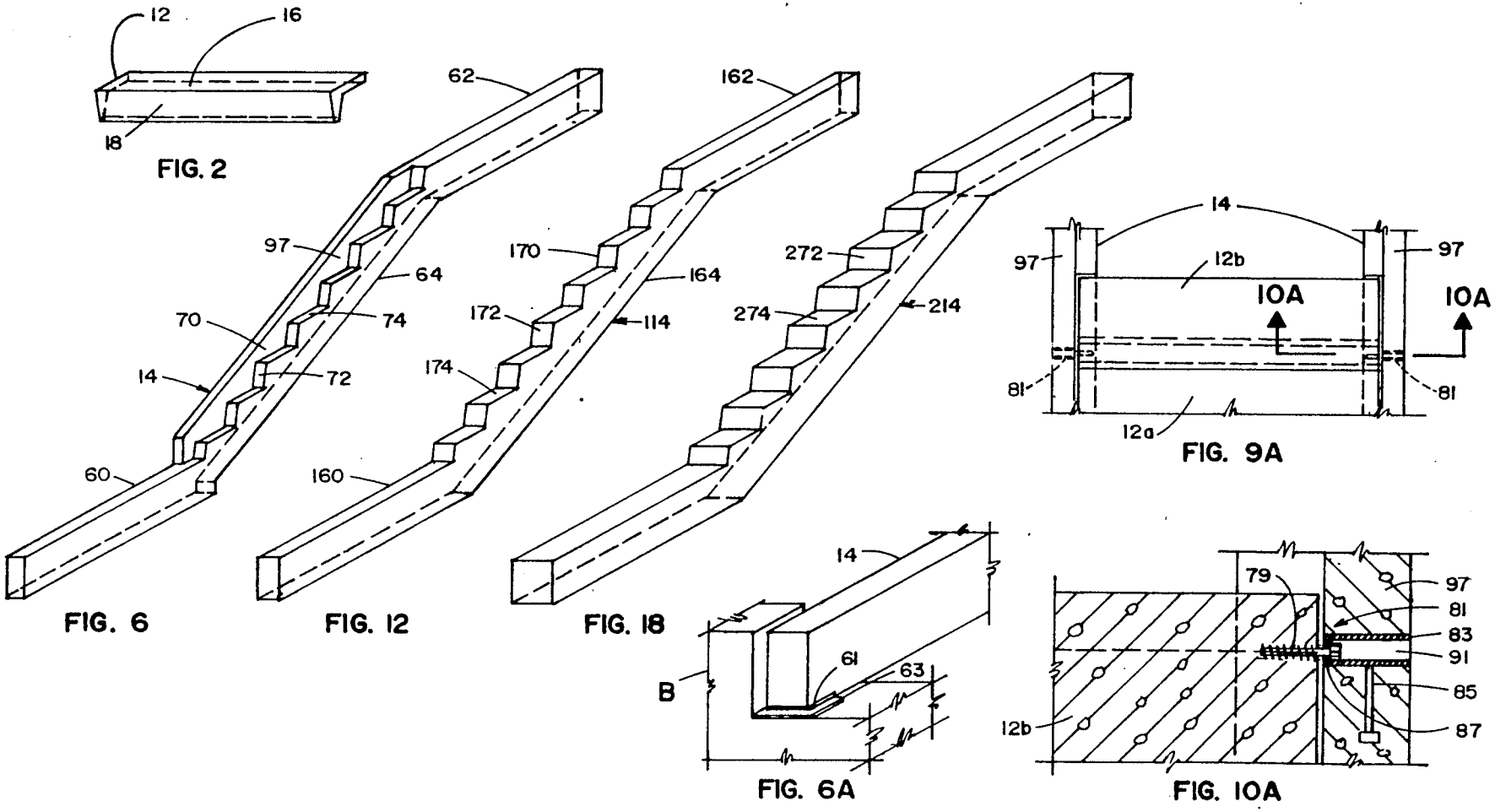
FIG. 2 is a perspective view of an individually precast step that is employed in the preferred embodiments of this invention.
FIG. 6 is a perspective view of the precast stringer employed in the embodiment of FIG. 1.
FIG. 6A is a cutaway perspective view of structure for supporting a stringer element to the building.
FIG. 9A is a plan view of an alternative technique for releasably fastening the stairs to the stringers.
FIG. 10A is a cross sectional view taken along line 10A—10A of FIG. 9A.
FIG. 12 is a perspective view of a stringer used in the embodiment of FIG. 11.
FIG. 18 is a perspective view of the stringer employed in the stair system of FIG. 17.

There is shown in FIG. 1 a precast concrete stair system 10 that includes a plurality of individually precast steps 12, two of which are shown, supported by a pair of elongate, generally parallel stringer elements 14. As best shown in FIG. 2, each precast step 12 includes a generally horizontally arranged tread portion 16 and a generally vertically arranged riser portion 18 that is integrally connected to and depends from tread portion 16.

Figure 5:
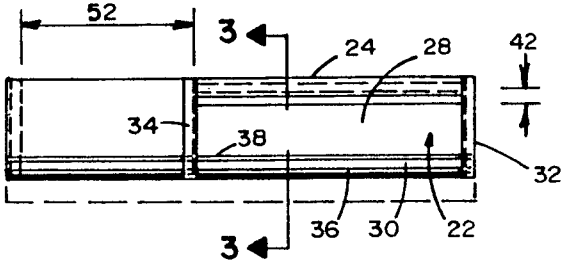
FIG. 5 is a plan view of the form of FIG. 3.
Figure 4:
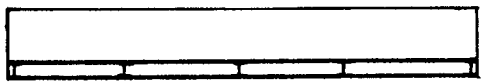
FIG. 4 is an elevational front view of the form of FIG. 3.
Figure 3:
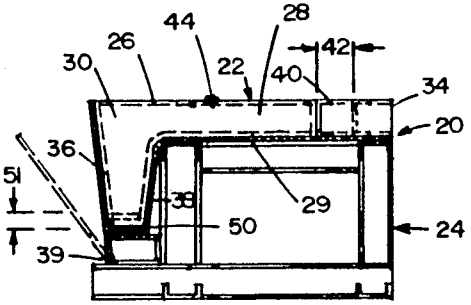
FIG. 3 is an elevational, cross sectional view, taken along line 3—3 of FIG. 5, of a form employed in constructing the precast step.

Step 12 is formed, as shown in FIGS. 3 through 5, by an apparatus 20 that includes a mold 22 supported on a frame 24. Both the mold and the frame may be constructed of various metal, plastic or wood materials. However, steel is a preferred component. Mold 22 includes a completely open upper end 26, a first generally horizontally disposed cavity portion 28 and a second cavity portion 30 that extends generally perpendicularly downwardly from cavity portion 28. Cavity portion 28 has a generally flat floor 29 and a laterally extending rear wall 40 that is adjustable in the direction of double headed arrow 42. Cavity portions 28 and 30 are bounded by a first L-shaped side wall 32 and an adjustable second L-shaped side wall 34. As shown most clearly in FIG. 3, cavity portion 30 includes a forward wall 36 and a rearward wall 38 that are tapered in a generally downward direction. Forward wall 36 is pivotably mounted to frame 24 by a hinge 39.

To form a precast step, wet concrete material or other material such as plastic or fiberglass is poured in the direction of arrow 44 into mold 22 through entrance 26. A conventional reinforcing material such as welded wire fabric, not shown in FIG. 3, is deposited within the concrete. The concrete is allowed to harden within the mold 22 in a conventional manner. Tread portion 16 forms in cavity portion 28 and riser portion 18 forms in cavity portion 30. Before the concrete hardens, a hardening or wear resistent substance, which may include aluminum oxide, granite, emery or various other metallic or stone finishes, is mixed into the concrete so that the hardening substance is formed integrally along the upper surface of tread portion 16. This substance prolongs the life of the step and reduces replacement and repair costs.

The lateral width of the tread and riser, as well as the height of the tread and the depth of the riser, may be adjusted by the use of various adjustment means shown in FIGS. 3 through 5. For example, the height of the riser may be shortened by introducing a wooden, plastic or metal block or filler element 50 in cavity portion 30 before the precast concrete is poured into mold 22. The size of filler element 50 is selected, as indicated in phantom by arrow 51, to provide a desired riser height. Similarly, the depth of tread portion 16 is adjusted by moving rear wall 40 as indicated by double headed arrow 42 before the concrete is poured into the mold. The lateral width of the stair system is likewise adjusted by moving adjustable side piece 34 as shown by double headed arrow 52 to a position desired within mold 22. Concrete material is then poured into the mold to the right of side piece 34.

When material 44 has hardened, it is removed from the mold by pivoting open forward wall 36 and removing the completed step 12, shown in FIG. 2. Although a pivoting forward wall 36 is shown, such a pivotal attachment is not required in all embodiments. The downward taper or draft of walls 36 and 38 facilitates the removal of the formed step 12 from the mold. Additionally, the downward draft forms a riser portion 18 having a like downward draft or taper. This draft should be at least $\frac{1}{4}''$ for every foot of riser height and preferably is at least $1\frac{1}{2}''$ for each foot of riser height. Such a draft further permits sufficient material to be included in steps 12 so that the step maintains a fire rating of at least two hours. The welded wire fabric formed within the step, and shown in FIGS. 10, 16 and 20, is fire retardant and further adds to the improved fire rating of the step.

Each step 12 is mounted between a pair of complementary stringer elements 14, shown alone in FIG. 6. The stringer elements extend generally between respective floor levels of the building. The lowermost stringer elements are mounted between the ground or first floor and the second floor. Each stringer element 14 includes a lower stringer extension 60, an upper stringer extension 62 and an intermediate stringer section 64 that interconnects sections 60 and 62. Either or both of the lower and upper stinger extensions sections 60 and 62 may support a respective landing 66, shown in FIG. 1. Landing 66 typically comprises a slab of concrete or similar material that is mounted to the stringer extensions by bolts, welding self-tapping screws or other attachment means. Analogous manners of attachment between the stringer elements and steps are described more fully below. The lowermost stringer elements 14 of the stair system are typically mounted between the ground level and second floor level by mounting lower extension 60 to the ground in a conventional manner. The upper stringer extensions 62 are secured to the building as shown in FIG. 6A. Each stringer element 14 includes a weld plate 61 that is cast into the bottom surface of the stringer element. A complementary weld plate 63 is attached to building structure B by casting, welding or other conventional means. Plates 61 and 63 are engaged and welded together to attach the stringer element 14 to structure B.

The intermediate stringer section 64 includes a step-shaped recessed portion 70 that generally conforms in shape to the individual steps 12. More particularly, the inside surface of each riser 18 engages a respective generally vertical stringer surface 72 and the bottom surface of each tread 16 engages a respective horizontal stringer surface 74.

Figure 7:
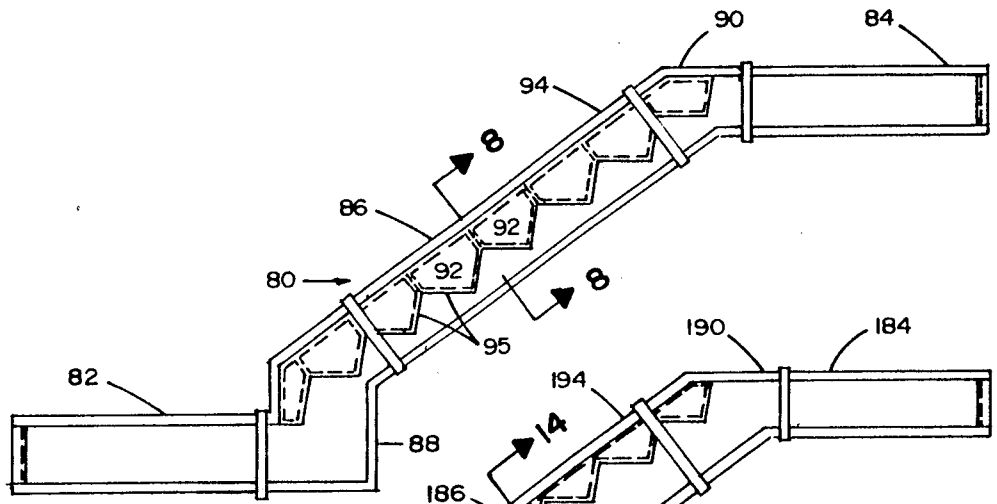
FIG. 7 is plan view of a form employed to construct the stringer of FIG. 6.
Figure 8:
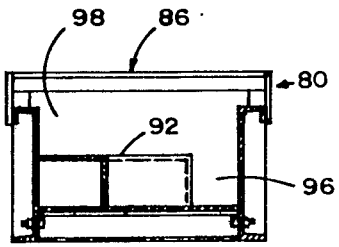
FIG. 8 is a cross sectional view taken along line 8—8 of FIG. 7.

A mold 80 for forming each stringer element 64 is shown in FIGS. 7 and 8. Mold 80 includes a lower extension cavity portion 82 and a generally parallel upper cavity extension portion 84. An intermediate inclined cavity portion 86 extends generally between portions 82 and 84. A first transition cavity portion 88 interconnects portions 82 and 86 and a second transition cavity portion 90 interconnects portions 84 and 86. Inclined portion 86 includes a plurality of core elements 92 that are arranged along side wall 94 of mold 80. Core elements 92 are constructed of various metal, plastic or wood materials and include wedge or step-shaped surfaces 95. As shown most clearly in FIG. 8, each core element 92 has a height which is only about one half that of the mold cavity. The core elements extend along wall 94 for the entire length of inclined portion 86 and into transition portions 88 and 90.

To form a stringer element 14, concrete is poured into the cavity of mold 80 so that it fills portions 82, 84, 86, 88 and 90. As shown in FIG. 8, concrete fills the cavity in the area 96 beside each core element 92 and in the area 98 above each core element. As a result, when the stringer element 14 hardens and forms within mold 80 and is subsequently removed from the mold, a recessed porion 70 is formed, as shown in FIG. 6, and that recessed portion extends only partially across the width of the stringer element 14. After the precast material has hardened it is removed from mold 80 and erected in the manner shown in FIG. 1. An outside border 97 is formed along the recessed portion 70. Using a mold 80 of this type permits stringer elements to be formed in various sizes and step dimensions. The step dimensions may be altered simply by employing core elements 92 that are cut to provide the desired dimensions. The length or height of the stringer may be adjusted by employing an intermediate section 86 and transition sections 88 and 90 that are constructed with a respective desired size, angle or dimension.

After the two stringer elements 14 are formed and erected and the step elements 12 are mounted on the stringer elements, the steps 12 are removably attached to the stringer elements, as shown in FIGS. 9 and 10. Therein, a lower step **12*a* is mounted at each end to a respective stringer 14 by a self-tapping screw 100. As shown most clearly in FIG. 10, before step 12*a* is mounted to stringer 14, grout 102 is applied to surface 74, FIGS. 6 and 10 and the inside surface of portion 97, FIGS. 6 and 10, that engage the step 12*a*. The step is then engaged against the stringer and self-tapping concrete screw 100 is countersunk through step 12*a* and into surface 74 of stringer element 14. To reduce wear on the screws thread, a hole may be countersunk through step 12*a* before the step is mounted onto the stringer element. Welded wire fabric reinforcing material 89 is contained within step 12*a***.

After the lower step **12*a* is releasably attached to both stringer elements 14 in this manner, the next higher step 12*b* is similarly mounted to the stringer elements. Upper step 12*b* may also be releasably interconnected to lower step 12*a*. This connection is formed by an additional releasable self-tapping screw 104, FIGS. 9 and 10. Again, a grout 106 may be disposed between the adjacent steps to improve the connection. Screw 104 is countersunk through lower step 12*a* and into the bottom surface of upper step 12*b*. Upper step 12*b* is itself releasably attached to the stringer elements 14 and to the higher adjacent step in a similar manner. Screws 100 and 104** are removed by unscrewing them from the steps and stringers. Such releasable interconnection enables the respective steps to be quickly and conveniently removed and replaced, if necessary.

Alternatively, each step may be releasably fastened to each stringer 14 as shown by step **12*b* in FIGS. 9A and 10A. Therein step 12*b* is attached to portion 97 of each stringer 14 by a respective releasable fastener 81. Fastener 81 includes a tubular sleeve 83 that is cast in and extends through portion 97 and is held therein by an anchor 85. An annular element 87 welded to the inner end of sleeve 83 includes a hole for receiving a self tapping screw or bolt 79. After step 12*b* is mounted on stringers 14, screw 79 is introduced through sleeve opening 91 and through the hole in element 87. The screw is then engaged with the side of step 12*b* to hold the step in place. Screws 79 are unscrewed and removed through sleeve opening 91** so that the steps may be repaired or replaced.

An alternative stair system 110 according to this invention is shown in FIG. 11. In this system, individually precast steps 112 are mounted to stringer elements 114 that include recessed portions 170 that extend laterally across the entire width of each stringer element 114. In other words, the stringer elements 114 do not include border portions along their inclined surfaces.

A single stringer element 114 is shown alone in FIG. 12. Stringer element 114 includes upper and lower stringer extension portions 160 and 162 as well as an intermediate portion 164. Section 164 includes a recessed, generally step-shaped upper surface 170 that has a shape which generally conforms to the steps to be supported on the stringer elements 114.

Figure 13:
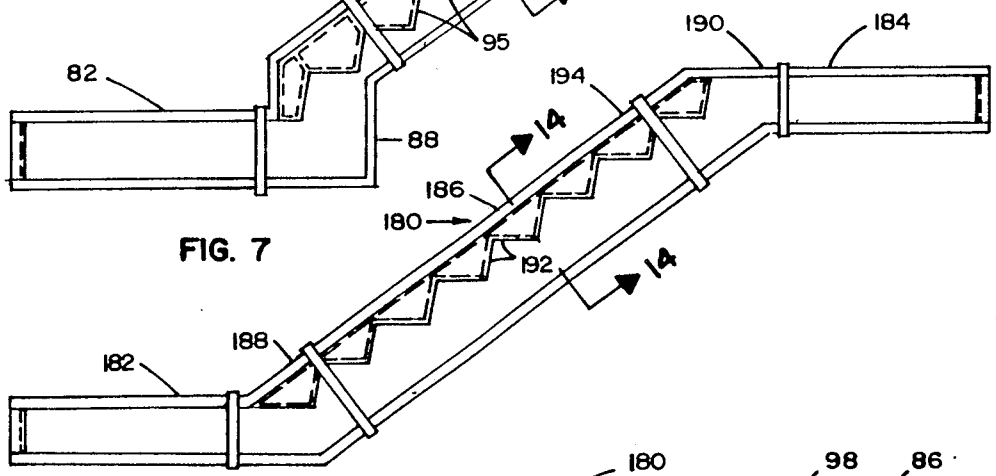
FIG. 13 is a plan view of the form used to create the stringer of FIG. 12.
Figure 14:
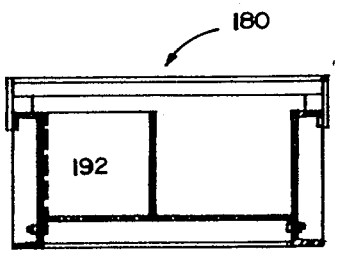
FIG. 14 is a cross sectional view taken along line 14—14 of FIG. 13.

Stringer element 114 is constructed by a mold 180, shown in FIGS. 13 and 14. As in the prior embodiment, mold 180 includes lower and upper mold cavity portions 182 and 184, as well as an inclined intermediate portion 186 and transition portions 188 and 190. Core elements 192 are arranged along wall 194 of inclined portion 190. As shown most clearly in FIG. 14, each core element is generally wedge shaped and has a step-shaped surface. The core element 192 has a height that generally matches the depth of the mold cavity. Accordingly, when precast material is poured into the mold cavity and formed into the stringer elements, those elements exhibit a step-shaped surface 170 that extends across the entire width of the stringer element 114 as shown in FIGS. 11 and 12.

An alternative means for releasably connecting the steps 112 to the stringer elements 114 is shown in FIGS. 15 and 16. In particular, each step 112*a* and 112*b* is releasably connected at each end to a respective stringer element 114 and to its adjacent step by a weld plate assembly 200. Each weld plate assembly 200 interconnects the riser of a particular step 112*b* with the tread portion of a lower step 112*a* and with a vertical surface 172 of stringer element 14. A representative weld plate assembly 200 is shown in FIG. 16. Tread portion 116 of step 112*a* has an angled metal piece 201 cast into the upper and front surface thereof. An anchoring bar 203 extends from piece 201 into the tread portion. Riser portion 118 of upper step 112*b* includes a similar angled piece 205 and anchoring member 207 precast therein such that the broad surfaces of piece 205 are formed in the inside and bottom surfaces of riser 118. Reinforcing material 189 extends throughout both steps.

A complementary, generally L-shaped angled metal plate 208 is cast into stringer element 114 such that one leg 213 of element 208 is generally flush with surface 172 and the other leg 215 extending perpendicularly therefrom is generally flush with the outer face of the stringer element 114.

To releasably interconnect the steps 112*a*, 112*b* and the stinger elements, a grout 202 is applied to the step-shaped surfaces 172 and 174 of each stringer element 114. Step 112*a* is then mounted on stringers 114 and step 112*b* is subsequently mounted on the stringers in engagement with step 112*a*. The grout is applied on the mating surfaces between steps 112*a* and 112*b*, i.e. on the bottom of riser 48 of step 112*b* and on the forward edge of the upper surface of tread portion 116 of step 112*a*. Before steps 112*a* and 112*b* are mounted, a second, separate L-shaped weld plate 209 is conformably juxtaposed against plate 208 so that a first one of its surfaces, 217, is interposed between steps 112*a* and 112*b* and leg 213 of plate 208. A second perpendicular surface 219 of plate 209 extends over the outer leg 215 of plate 208. Releasable interconnection between stringer 114 and both of the steps is then accomplished by welding plate 209 to plate 208 and to pieces 201 and 205 of steps 112*a* and 112*b*, respectively. A similar releasable connection is formed at the opposite end of the steps. As shown in FIG. 15, an additional weld attachment 221 may be formed between adjacent pairs of steps proximate the middle of the steps.

The steps are released from the stringer element by breaking the welded attachments, for example through use of an acetylene or similar means known in the art. A new step is then replaced by attaching it to the stair system in the manner described above.

A further alternative stair system 210 is shown in FIG. 17. This system again includes a plurality of steps 212 that are formed in the manner previously described. In this embodiment, however, only a single stringer element 214 is employed and that stringer element is disposed generally centrally beneath steps 212.

As shown in FIG. 18, stringer element 214 is shaped somewhat similarly to the stringer element employed in FIG. 12. Indeed, stringer element 214 is constructed in a mold analogous to the mold shown in FIG. 13 and 14. However, because only a single stringer element is employed the stringer element is formed to be considerably thicker than that shown in the previous embodiment so that the load of the stairs is adequately supported.

As shown in FIGS. 19 and 20, the steps may be releasably interconnected to stringer element 214 by an appropriate bolt and sleeve attachment mechanism 300. Step 212*b* and all other steps are mounted to stringer 214 so that the bottom surface of the tread portion 216 engages the upper surface 274 of stringer element 214 and the inner surface of riser portion 218 engages the generally vertical surface 272 of stringer element 214. Again, grout 302 is employed between the step and the stringer element to enhance the strength of attachment between these elements.

Mechanism 300 includes a bolt element 301 that extends through a countersunk opening 302 in tread portion 216. A threaded sleeve 303 is disposed within the stringer. The sleeve may be precast into the stringer, or, alternatively, an opening may be formed in the stringer and the sleeve may be inserted into that opening after the stinger is formed. The step 212*b* is mounted onto stringer 214, so that the countersunk hole 302 is generally aligned with the opening in stringer element 214 and more specifically with the opening in sleeve 303. Bolt 301 is then inserted through opening 302 and into the opening of sleeve 303. The bolt is then tightened into the sleeve. If sleeve 303 is inserted into the stringer element 214 following casting of the stringer element, the tightening of the bolt into the sleeve expands the sleeve so that it engages and is locked to the stringer element. Adjacent steps 212*a* and 212*b* are interconnected typically by grout as previously described.

Step 212*b* is removed simply by unfastening bolt 301 and lifting the step from stinger element 214. A new step is replaced in that position on the stinger element by engaging it with the stringer element and reattaching the bolt in the manner described above.

Accordingly, the stair system of this invention provides a number of significant advantages. The steps and the stringer elements are individually precast so that their size may be readily adjusted to fit buildings of varying height. Moreover, the system of this invention does not employ a flat slab at the bottom of the stairway. As a result, concrete is saved and the weight of the stair system is reduced. Nonetheless, the thickness of the stair system is designed such that an acceptable fire rating is provided. The unique ability of this invention to employ special hardening additives on the upper surface of the treads further enhances the economic advantages provided by this system.

Although specific features of the invention are shown in some of the drawings and not others, this is for convenience only as each feature may be combined with any and all of the other features in accordance with this invention.

Other embodiments will occur to those skilled in the art and are within the following claims.

What is claimed is:

1. A precast stair system comprising:

a plurality of individually precast steps, each step including a tread portion and a riser portion that is integrally connected to said tread portion and extends generally downwardly therefrom;

elongate stringer means that are precast independently of said steps for supporting said steps, said stringer means including a generally horizontal extension portion formed on at least one end for supporting a landing;

means for securing at least one said extension portion to a building which said stair system ascends; and means for releasably fastening said steps to said stringer means.

2. The stair system of claim 1 further including means for releasably interconnecting each adjoining pair of said steps.

3. The stair system of claim 1 in which said tread portion has an upper surface that includes precast concrete and an integral hardening substance that increases the hardness of said upper surface.

4. The stair system of claim 1 in which said tread portion and said riser portion have a thickness such that said steps exhibit a two hour fire rating.

5. The stair system of claim 1 in which said riser portion includes forward and rearward walls that both have a generally downward taper, said forward wall having a selected one of a variety of tapered angles.

6. The stair system of claim 5 in which said riser portion includes a draft of at least ¼" per foot.

7. The stair system of claim 5 in which said riser portion includes a draft of approximately 1½" per foot.

8. The stair system of claim 1 in which said stringer means include at least one element having a generally step-shaped recessed portion for conformably receiving the tread and riser portions of said steps.

9. The stair system of claim 8 in which said recessed portion extends across the entire width of said stringer element.

10. The stair system of claim 8 in which said recessed portion extends partially across the width of each stringer element.

11. The stair system of claim 8 in which said stringer means include a pair of generally parallel stringer elements for supporting respective ends of said steps.

12. The stair system of claim 8 in which said stringer means include a single stringer element that extends generally centrally beneath said steps.

13. The stair system of claim 1 in which said means for releasably fastening include at least one self tapping concrete screw.

14. The system of claim 1 in which said means for releasable fastening include a threaded collar cast in said stringer means and alignable with a complementary opening in said step and a threaded element receivable by said opening and engagable with said collar to releasably fasten said step and said stringer means.

15. The stair system of claim 1 in which said means for releasably fastening include complementary weld plates attached to said stringer means and said step respectively and being engagable and selectively welded together to releasably fasten said step and said stringer means.

16. The stair system of claim 1 in which said means for releasably fastening include a sleeve cast into said stringer means and having an open first end and second end that has a stop with a central opening connected thereto, said sleeve being alignable with an opening in a step mounted on said stringer, and an elongate attachment element having a head and threaded portion, said attachment element being introducible through said sleeve and through said central opening such that said threaded portion is received by said step opening and said head engages said stop to releasably fasten said step and said stringer means.

17. A mold for forming individual steps in a precast stair system comprising:

an open upper end for receiving casting material;

a first cavity portion having a generally flat horizontally extendable floor for forming a tread portion of said step;

a second cavity portion that is connected to and depends from said first cavity portion, said second cavity portion including a rearward wall that is connected to said floor of said first portion, a forward wall that is spaced therefrom and hinge means for supporting said forward wall and allowing said forward wall to pivotably alternate between various positions; and means for adjusting the sizes of said first and second cavity portions to adjust the sizes of the tread and riser, respectively.

18. The mold of claim 17 in which said means for adjusting include at least one wall that is moveable relative to at least one of said cavity portions to adjust the size of said cavity portions.

19. The mold of claim 17 in which said means for adjusting include at least one filler element that is receivable in said cavity portions to adjust the size cavity portions.

20. A stringer mold for a precast stair system comprising:

a pair of generally parallel elongate extension cavity portions for forming upper and lower extension portions at the respective ends of said stringer, at least one of said extension portions supporting a landing;

an inclined cavity portion that extends generally between said upper and lower extension cavity portions and includes a plurality of generally step-shaped core elements that form a generally step-shaped recessed portion of said stringer for supporting the steps of said stair system, said upper extension cavity portion extending in a first, generally horizontally alignable direction from one said transition cavity portion and said lower extension cavity portion extending in an opposite, generally horizontally alignable direction from the other said transition cavity portion; and a pair of transition cavity portions having predetermined angles and interconnecting respective ends of said inclined cavity portion with said extension cavity portions.

21. A method of constructing a precast stair system comprising the steps of:

introducing casting material into a mold having an open upper end, a generally horizontally extendable first cavity portion and a generally vertically extendable second cavity portion that is dependably connected to said first cavity portion;

allowing said casting material to harden in said mold to form a precast step, wherein said material in said first cavity portion forms a tread portion of said step and said material in said second cavity portion forms a riser portion of said step;

removing the precast step from said mold;

independently casting stringer means for supporting a plurality of precast steps;

forming an extension portion on at least one end of said stringer means;

releasably fastening said steps to said stringer means; and mounting a landing on said extension portion of said stringer means.

22. The method of claim 21 further including the step of selectively introducing a filler element into said mold to adjust the size of said step.

23. The method of claim 21 further including the step of introducing a hardening substance into said casting material before said casting material hardens to form a hardened upper surface in said tread portion.

24. A precast stair system comprising:

a plurality of individually precast steps, each step including a tread portion and a riser portion that is integrally connected to said tread portion and extends generally downwardly therefrom;

elongate stringer means that are precast independently of said steps for supporting said steps, said stringer means including a single stringer element that extends generally centrally beneath said steps and has a generally step-shaped recess portion for comformably receiving the tread and riser portions of said steps; and means for releasably fastening said steps to said stringer means.

* * * * *